US005652650A

United States Patent [19]

Menjo et al.

[11] Patent Number: 5,652,650

[45] Date of Patent: Jul. 29, 1997

[54] COLOR IMAGE APPARATUS INCLUDING A PLURALITY OF DEVELOPING DEVICES HAVING A PARTICULAR SEQUENCE OF OPERATION

[75] Inventors: Takeshi Menjo, Tokyo; Yoshihiro Murasawa, Yokohama; Hisashi Fukushima, Kawasaki; Takashi Hasegawa, Ageo, all of Japan

[73] Assignee: Canon Kabushiki Kaisha, Tokyo, Japan

[21] Appl. No.: 643,529

[22] Filed: May 6, 1996

Related U.S. Application Data

[63] Continuation of Ser. No. 190,474, Feb. 2, 1994, abandoned.

[30] Foreign Application Priority Data

Feb. 5, 1993 [JP] Japan ..... 5-042260

[51] Int. Cl.[6] ..... G03G 15/01

[52] U.S. Cl. ..... 399/226

[58] Field of Search ..... 355/326 R, 327

[56] References Cited

U.S. PATENT DOCUMENTS

| | | | |
|---|---|---|---|
| 4,712,906 | 12/1987 | Bothner et al. . | |
| 4,849,795 | 7/1989 | Spehrley, Jr. et al. | 355/317 |
| 4,883,019 | 11/1989 | Menjo et al. | 118/691 |
| 5,036,364 | 7/1991 | Murasawa | 355/251 |
| 5,099,286 | 3/1992 | Nishise et al. | 355/272 |
| 5,111,242 | 5/1992 | Tanimoto et al. | 355/200 |
| 5,117,261 | 5/1992 | Sakai et al. | 355/207 |
| 5,121,163 | 6/1992 | Muramatsu et al. | 355/246 |
| 5,172,172 | 12/1992 | Amemiya et al. | 355/271 |
| 5,189,478 | 2/1993 | Hara et al. | 355/271 |
| 5,225,872 | 7/1993 | Fukushima | 355/208 |
| 5,249,024 | 9/1993 | Menjo | 355/282 |
| 5,281,504 | 1/1994 | Kanbayashi et al. | 430/99 |
| 5,294,959 | 3/1994 | Nagao et al. | 355/208 |
| 5,335,056 | 8/1994 | Muramatsu | 355/327 |
| 5,373,354 | 12/1994 | Tadokoro et al. | 355/326 R X |
| 5,499,088 | 3/1996 | Menjo | 355/285 |

*Primary Examiner*—Nestor R. Ramirez

*Attorney, Agent, or Firm*—Fitzpatrick, Cella, Harper & Scinto

[57] ABSTRACT

An image forming apparatus includes a movable image carrier, and a plurality of developing devices for developing a latent image formed on the image carrier. The plurality of developing devices contain developing agents of different colors and are arranged in the direction of movement of the image carrier. The plurality of developing devices are arranged in an ascending order of the visual sensitivity of the colors of the developing agents from the upstream side in the direction of movement of the image carrier, for example, in one aspect cyan, magenta, yellow and black developing devices may be sequentially arranged from an upstream side to a downstream side and operated in an order of cyan, magenta, yellow and black.

11 Claims, 8 Drawing Sheets

COLOR IMAGE APPARATUS INCLUDING A PLURALITY OF DEVELOPING DEVICES HAVING A PARTICULAR SEQUENCE OF OPERATION

This application is a continuation of application Ser. No. 08/190,474 filed Feb. 2, 1994, now abandoned.

BACKGROUND OF THE INVENTION

1. Field of the Invention

The present invention relates to an image forming apparatus of an electrophotographic type or an electrostatic recording type, such as a copying machine or a laser printer, and, more particularly, to an image forming apparatus which forms an output image by transferring a visible image formed on an image carrier onto a recording medium carried by a recording medium carrier.

2. Related Background Art

FIG. 8 shows an example of a conventional electrophotographic color image forming apparatus. This color image forming apparatus includes a photosensitive drum 1 as an image carrier which is arranged so as to be rotatable in a direction indicated by an arrow in FIG. 8. Around the photosensitive drum 1, there are disposed a charger 2 (in this example, a corona charger) for evenly charging the surface of the photosensitive drum 1, an image exposing means 3 for forming an electrostatic latent image corresponding to image information on the photosensitive drum 1, a developing unit 400 for developing the electrostatic latent image formed on the photosensitive drum 1 into a visible image, a transfer unit 5 including a transfer drum 5*a* as a recording medium carrier, and a cleaner 6 for removing the developing agents remaining on the photosensitive drum 1.

In this conventional example, the image exposing means 3 is a laser beam exposing unit consisting of, e.g., a polygon mirror and a lens system. That is, a reflected light image obtained from an original scanner (not shown) is modulated with color image signals which are color-separated to have their respective colors by, e.g., a color separation filter., and is output as light images from a laser output unit. The laser beam exposing unit radiates these light images or light images E corresponding to these light images onto the photosensitive drum 1 (with a diameter of, e.g., 82 mm), forming electrostatic latent images corresponding to the color image signals of their respective colors.

In this conventional example, a rotary developing unit is also used as the developing unit 400. This rotary developing unit mounts four developing devices, e.g., a black developing device 400K, a cyan developing device 400C, a magenta developing device 400M, and a yellow developing device 400Y, on a rotating member 400*a* which rotates about a central shaft 400*b*. The rotary developing unit rotates a desired developing device to a development position opposing the photosensitive drum 1 and develops the latent image formed on the photosensitive drum 1.

The overall operation sequence of this color image forming apparatus will be briefly described below by taking a full-color mode sequence as an example. First, the photosensitive drum 1 is evenly charged by the charger 2. Subsequently, the image of an original is exposed by a laser beam which is modulated with, e.g., a cyan image signal, and the resulting electrostatic latent image is formed on the photosensitive drum 1. This latent image is developed by the cyan developing device 400C which is moved to the development position in advance, and the corresponding visible image (toner image) of cyan is formed by a toner consisting primarily of a resin on the photosensitive drum 1.

On the other hand, a recording medium such as a transfer sheet is supplied from a recording medium cassette 7*a*, 7*b*, or 7*c* (the recording medium is also fed manually in some cases) through a paper path indicated by a dotted line in FIG. 8 by a conveyor system constituted by pickup rollers, paper feed guides, paper feed rollers, and the like. The recording medium is wound around the transfer unit 5 in synchronism with a predetermined timing. In this conventional example, the transfer unit 5 includes the transfer drum 5*a* (with a diameter of, e.g., 164 mm) as a recording medium carrier, a transfer corona charger 5*b* for transferring the toner image formed on the photosensitive drum 1 onto the recording medium, an attraction corona charger 5*c* as an attraction charging means for attracting the recording medium to the transfer drum 5*a*, an attraction (contact) roller 5*g* serving as a counter electrode, an inner corona charger 5*d*, and an outer corona charger 5*e*. A recording medium carrier sheet 5*f* as recording medium carrying means consisting of a dielectric film is cylindrically, integrally looped around the circumferential opening of the transfer drum 5*a* which is axially supported to be rotatable.

The transfer drum 5*a* is rotated in a direction indicated by an arrow in FIG. 8 in synchronism with the photosensitive drum 1. In the transfer section, the cyan toner image developed by the cyan developing device 400C is transferred by the transfer charger 5*b* to the recording medium carried on the recording medium carrier sheet 5*f*. The transfer drum 5*b* keeps rotating to prepare for the transfer of an image of the next color (e.g., magenta).

The cleaner 6 removes substances, such as the residual toner, deposited on the photosensitive drum 1 from which the toner image is transferred. Thereafter, the photosensitive drum 1 is again charged evenly by the charger 2 and subjected to the above image exposure using a laser beam modulated with the next magenta image signal. During the exposure, the developing unit 400 rotates to move the magenta developing device 400M to the predetermined development position, thereby performing a predetermined magenta development.

In the transfer section, the resultant magenta toner image is transferred by the transfer charger 5*b* to the recording medium carried on the recording medium carrier sheet 5*f*. Consequently, the magenta toner image overlaps the cyan toner image. The transfer drum 5*a* keeps rotating to prepare for the transfer of an image of the next color (e.g., yellow).

Subsequently, the above process is similarly performed for the formation and the transfer of yellow and black images. When the overlapping transfer of the four color toner images is completed, the recording medium is discharged by a separating charger 5*h* and separated from the transfer drum 5*a* by a separating means 8 such as separating grippers. The recording medium thus separated is conveyed to a fixing unit (in this example, a heat roller fixing unit) 9 by an appropriate conveying means along the paper path indicated by the dotted line in FIG. 8. The recording medium is fixed at one time and delivered onto a tray 10 outside the apparatus. When the whole full-color print sequence is ended as described above, a predetermined full-color print image is formed.

The conventional image forming apparatus with the above arrangement, however, has the following drawbacks.

Since the developing unit is of a rotary type, it takes much time to cause the developing unit to rotate and move a desired developing device to the development position, resulting in time-consuming image formation.

For example, when two sheets of A4-size or letter-size (LTR) as a standard recording medium are attracted onto the recording medium carrier sheet 5f of the transfer drum 5a, as is well known, spacings between the sheets are narrowed. In many instances, therefore, a latent image to be developed which is formed on the photosensitive drum has already passed through the development position when a corresponding developing device of the developing unit is moved to the development position; i.e., the movement of the developing device is too slow. Consequently, development cannot be performed until the transfer drum rotates one more time, so the photosensitive drum must also perform an unnecessary extra rotation. This undesirably prolongs the time from the start to the completion of the image formation.

In addition, if the developing unit includes developing devices using two-component developing agents (to be described later), toner particles separated from carrier particles are liable to scatter. In this case, in the rotary developing unit, toner particles scatter from a developing device moved downward in the direction of gravity, contaminating the interior of the image forming apparatus.

Furthermore, since the diameter of the photosensitive drum is small, the photosensitive drum is readily damaged by transfer charging several times. That is, a drum (to be abbreviated as an OPC drum hereinafter) using an organic photoconductor (OPC) as a photosensitive body is generally used as the photosensitive drum for the industrial reason that the OPC is inexpensive and harmless. This photosensitive body is once negatively charged and then positively charged in performing transfer. If the positive transfer charging is performed with no recording medium, the photosensitive body transits to the positive potential side under the influence of the positive charge.

Generally, if the OPC drum which is to be used on the negative charging side is positively charged, it becomes difficult for the drum to return to the negative potential side. This results in unstable charging and unstable image formation after that.

For the reasons described above, there has been proposed an image forming apparatus using a large-diameter photosensitive drum and fixed developing devices.

An example of a conventional electrophotographic color image forming apparatus with this arrangement will be described below with reference to FIG. 9. Note that the same reference numerals as in the color image forming apparatus shown in FIG. 8 denote the same members, parts, and elements in FIG. 9, and a detailed description thereof will be omitted.

In the apparatus illustrated in FIG. 9, a photosensitive drum 1 has a large diameter. Around this photosensitive drum 1, cyan, magenta, yellow, and black developing devices 500C, 500M, 500Y, and 500K are arranged at fixed positions in the direction of rotation of the photosensitive drum 1. Note that the developing agent contained in each developing device is a two-component developing agent.

This conventional image forming apparatus shown in FIG. 9, however, has the following problems.

That is, in the apparatus shown in FIG. 9, scattering of toner particles to some extent is unavoidable even though the extent of scattering is smaller than that in the conventional rotary developing unit mentioned earlier; i.e., toner particles scatter to some extent even for a developing unit arranged at a fixed position. If toner particles scatter from the cyan developing device 500C on the upstream side, then these scattering toner particles flow to the downstream side along the rotating direction of the photosensitive drum 1 and are mixed in the magenta, yellow, and black developing devices 500M, 500Y, and 500K. Likewise, toner particles scattering from the magenta developing device 500M flow to the downstream side and are mixed in the yellow and black developing devices 500Y and 500K. This color mixing is notable especially when two-component developing agents are used as in this example.

In the developing device in which the colors are mixed as described above, e.g., in the yellow developing device, the toner components of magenta and cyan are mixed. The resultant toner is deposited on a yellow color-separated latent image during development. Consequently, an imperfect image in which colors are mixed is formed. This similarly occurs in the magenta developing device as another developing device. However, no such inconvenience as in the yellow and magenta developing devices takes place in the black developing device on the most downstream side. This is so because, even if the cyan, magenta, and yellow toner components are mixed in the black toner, this color mixing is not so conspicuous.

More specifically, since the visual sensitivity of black is high, no serious problem arises even if the toner components of cyan, magenta, and yellow with a lower visual sensitivity are mixed in with the black toner.

Another drawback Of the conventional image forming apparatus illustrated in FIG. 9 is as follows.

As shown in FIG. 10, when an A3-size recording medium (recording paper) P is fed to a transfer drum 5a, a portion with a length a [mm] in which no recording paper P exists is present on the transfer drum 5a. To transfer toner images of the respective colors to one A3-size recording sheet in this condition, the toner images are formed in sequence from the cyan developing device 500C on the most upstream side to those on the downstream side in an order of the magenta developing device 500M to the yellow developing device 500Y to the black developing device 500K. The toner images thus formed are sequentially transferred to the recording paper P. This toner image transfer is executable without unnecessarily idling the transfer drum 5a, since switching between the developing devices can be performed while the transfer drum 5a rotates a distance of a [mm].

If, however, the second recording paper is continuously fed in a continuous copying operation, then there is a distance of only a [mm] between the trailing end of the first recording paper to the leading end of the second recording paper. In this case, it is necessary to perform switching from the black developing device 500K to the cyan developing device 500C. However, the distance between the black and cyan developing devices 500K and 500C is b [mm] which is longer than the distance ba [mm]. For this reason, the leading end of the first cyan latent image of the second recording paper has already passed through the cyan developing device 500C when the trailing end of the last latent image of the first recording paper passes through the black developing device 500K.

In the above sequence, therefore, feed of the second recording paper is normally performed after the transfer drum 5a is idled once, thereby performing the development of the cyan latent image first. Consequently, the copying speed is lowered by this one idling of the transfer drum, and so degradation in mechanical performance is unavoidable.

If an independent developing motor is incorporated in each individual developing device so that in switching from the black developing device to the cyan developing device, the cyan developing device is operated to develop the cyan latent image on the second recording medium while the black developing device is developing the black latent image, continuous copying can be performed without idling the transfer drum.

In the above development system using the two-component developing agents, however, the torque of each developing device is large, and so a large-torque motor must be used to rotate the developing sleeve. The use of four such large-torque motors leads to a large increase in the manufacturing cost of the whole apparatus.

If a single developing device driving motor is used to rotate the developing sleeves of the individual developing devices via clutches of the respective colors, a large increase in cost can be avoided. However, since the torque of each developing device is large as described above, a very large torque variation occurs if the cyan developing device is driven during the development of the black latent image. This results in an uneven development in particularly the black latent image. Therefore, it is impossible to put this system into practical use.

SUMMARY OF THE INVENTION

It is an object of the present invention to provide an image forming apparatus which makes the influence of color mixing inconspicuous even if toner particles of one color scatter and are mixed in a developing device of another color.

It is another object of the present invention to provide an image forming apparatus in which developing devices are arranged in an ascending order of the visual sensitivity of the color of a developing agent from the upstream side in the direction of movement of an image carrier.

It is still another object of the present invention to provide an image forming apparatus for forming images at a high speed by eliminating unnecessary operations.

It is still another object of the present invention to provide an image forming apparatus in which a plurality of developing devices are operated in sequence from those on the downstream side to those on the upstream side in the direction of movement of an image carrier.

Other objects of the present invention will become apparent from the following detailed description.

DETAILED DESCRIPTION 0F THE PREFERRED EMBODIMENTS

The preferred embodiments of the present invention will be described in detail below with reference to the accompanying drawings.

Figure 1:
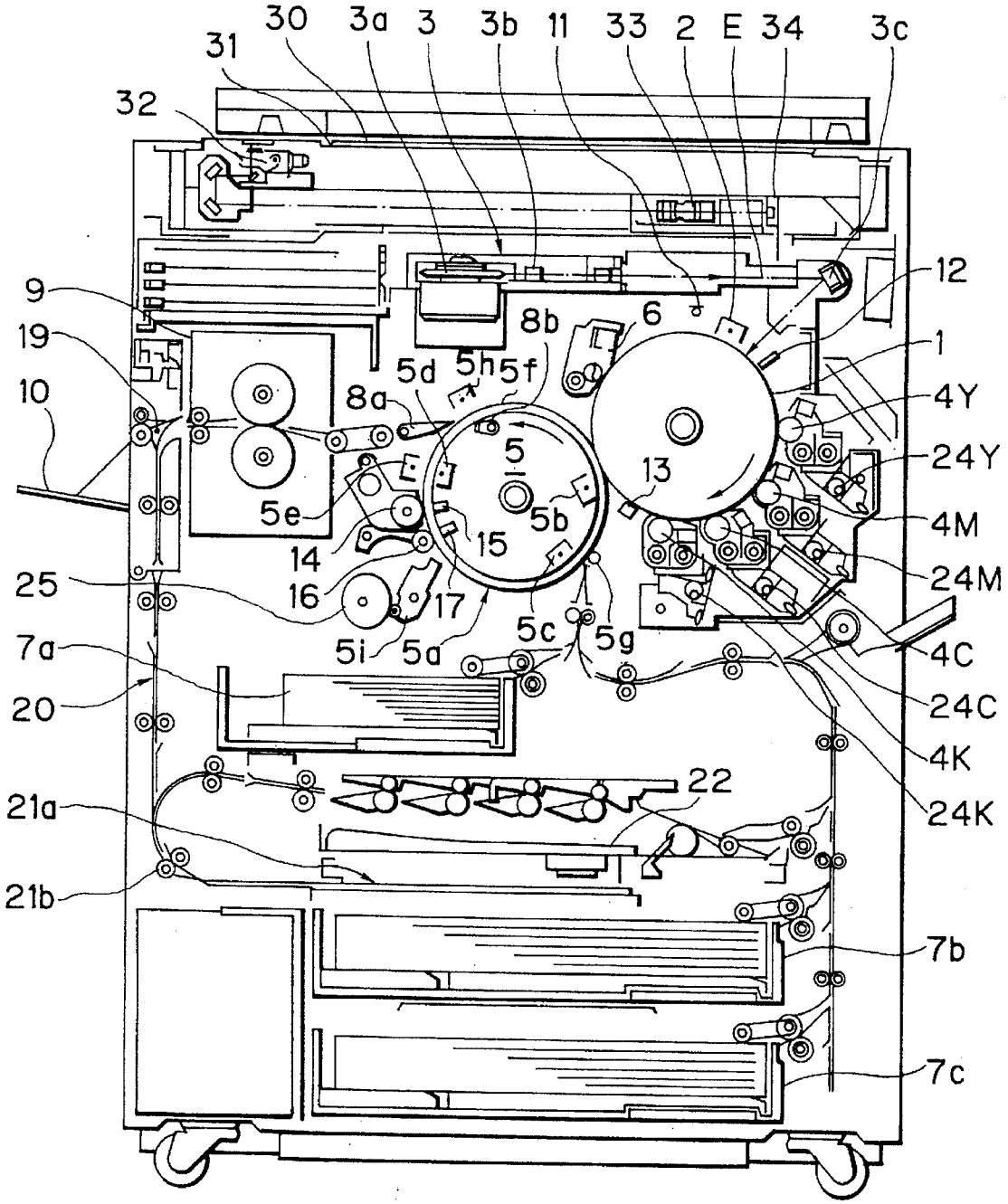
FIG. 1 is a schematic view showing the overall arrangement of a first embodiment in which the present invention is applied to an electrophotographic color image forming apparatus.

FIG. 1 is a schematic view showing the overall arrangement of the first embodiment in which the present invention is applied to an electrophotographic color image forming apparatus.

The apparatus shown in FIG. 1 will be described first.

The color image forming apparatus illustrated in FIG. 1 has a digital color image reader section in its upper portion and a digital color image printer section in its lower portion.

In the reader section, an original 30 is placed on an original glass plate 31 and subjected to exposure-scan by an exposure lamp 32. The obtained image of the reflected light from the original 30 is focused on a full-color sensor 34 through a lens 33 to obtain a color-separated color image signal. This color-separated color image signal is amplified by an amplifier circuit.(not shown), processed by a video processing unit (not shown), and supplied to the printer section.

In the printer section, a photosensitive drum 1 as an image carrier is a large-diameter photosensitive drum 180 mm in diameter and supported to be rotatable in a direction indicated by an arrow in FIG. 1. Around this photosensitive drum 1, there are disposed a pre-exposure lamp 11 for initializing the surface of the photosensitive drum 1, a charger 2 (in this embodiment, a corona charger) for evenly charging the surface of the photosensitive drum 1, an image exposing means 3 for forming an electrostatic latent image corresponding to image information on the photosensitive drum 1, a potential sensor 12 for sensing the surface potential of the photosensitive drum 1, a fixed developing unit including four developing devices 4C, 4M, 4Y, and 4K containing developing agents (toner) of different colors for developing the electrostatic latent image formed on the photosensitive drum 1 into a visible image, a photodetecting means 13 for detecting the toner amount on the photosensitive drum 1, a transfer unit 5 including a transfer drum **5*a* as a recording medium carrier, and a cleaner 6 for removing the developing agents remaining on the photosensitive drum 1**.

The image exposing means 3 of this embodiment consists of, e.g., a polygon mirror **3*a*, a lens 3*b*, and a mirror 3*c*. Output laser beams E from a laser output unit, which are modulated in accordance with the color-separated color image signals of the respective colors from the reader section, are reflected by the polygon mirror 3*a* and projected onto the surface of the photosensitive drum 1 via the lens 3*b*** and the mirror 3c, forming electrostatic latent images corresponding to the color image signals of the respective colors.

To perform image formation in the printer section, the photosensitive drum 1 is rotated in the direction indicated by the arrow shown in FIG. 1, and the surface of the photosensitive drum 1 is discharged and initialized by the pre-exposure lamp 11 and then evenly charged by the charger 2. Subsequently, the image exposing means 3 sequentially radiates the light images E corresponding to the color-separated image signals of the respective colors onto the surface of the photosensitive drum 1, thereby forming electrostatic latent images in a predetermined color order.

Thereafter, the developing devices are operated in a predetermined developing order, i.e., an order of cyan (C), magenta (M), yellow (Y), and black (K), thereby developing the latent images formed on the photosensitive drum 1 to sequentially form toner images consisting primarily of a resin on the photosensitive drum 1.

In an apparatus for overlapping colors by using toner, it is preferable with respect to the image quality on a recording medium to perform the development in an order of cyan, magenta, yellow, and black as described above.

The developing devices 4C, 4M, 4Y, and 4K of the developing unit are switched by the operations of eccentric cams 24C, 24M, 24Y, and 24K, respectively. That is, a predetermined one of the developing devices is selectively moved closer to the photosensitive drum 1 to perform development in accordance with the color of a latent image formed.

The switching between the developing devices involves the operation of each color developing device to move its developing sleeve closer to the photosensitive drum during development, the application of bias, and the operation performed to shift the ON/OFF of the rotation of the developing sleeve to each color developing device.

On the other hand, a recording medium such as a transfer sheet is supplied from a recording medium cassette 7a, 7b, or 7c (the recording medium is also fed manually in some cases) by a conveyor system constituted by pickup rollers, paper feed guides, paper feed rollers, and the like. The recording medium is wound around the transfer unit 5 in synchronism with a predetermined timing. In this embodiment, the transfer unit 5 includes the transfer drum 5a with a diameter of 180 mm as a recording medium carrier, a transfer corona charger 5b for transferring the toner image formed on the photosensitive drum 1 onto the recording medium, an attraction corona charger 5c as attraction charging means for attracting the recording medium to the transfer drum 5a, an attraction (contact) roller 5g serving as a counter electrode, an inner corona charger 5d, and an outer corona charger 5e. A recording medium carrier sheet 5f as recording medium carrying means consisting of a dielectric substance is cylindrically, integrally looped around the circumferential opening of the transfer drum 5a which is axially supported to be rotatable. A dielectric sheet such as a polycarbonate film is used as the recording medium carrier sheet 5f.

The transfer drum 5a is rotated in the direction indicated by the arrow in FIG. 1 in synchronism with the photosensitive drum 1. In the transfer section, the cyan toner image developed by the cyan developing device 4C is transferred by the transfer charger 5b to the recording medium carried on the recording medium carrier sheet 5f. The transfer drum 5b keeps rotating to prepare for the transfer of an image of the next color (e.g., magenta).

The cleaner 6 removes substances, such as the residual toner, deposited on the photosensitive drum 1 from which the toner image is transferred. Thereafter, the photosensitive drum 1 is again charged evenly by the charger 2 and subjected to an image exposure as described above by a laser beam modulated by the next magenta image signal. The obtained magenta latent image is developed into a magenta toner image by the magenta developing device 4M. In the transfer section, the resulting magenta toner image is transferred by the transfer charger 5b to the recording medium carried on the recording medium carrier sheet 5f. Consequently, the magenta toner image overlays the cyan toner image. The transfer drum 5a keeps rotating to prepare for the transfer of an image of the next color (e.g., yellow).

Subsequently, the above process is similarly performed for the formation and the transfer of yellow and black images. When the overlaying transfer of the four color toner images is completed, the recording medium is discharged by a separating charger 5h and separated from the transfer drum 5a by the actions of a separating push roller 8b and separating grippers 8a. The recording medium thus separated is conveyed to a fixing unit (in this example, a heat roller fixing unit) 9 by the conveying means. The recording medium is fixed at one time and delivered onto a tray 10 outside the apparatus. When the whole full-color print sequence is ended as described above, a predetermined full-color print image is formed.

To form images on both surfaces of the recording medium,.a conveyance path switching guide 19 is driven immediately after the recording medium is delivered from the fixing unit 9, thereby guiding the recording medium to a reversal path 21a through a conveyance vertical path 20. Thereafter, reversal rollers 21b reversely rotate to move the recording medium backward in a direction opposite to the direction in which it is fed, such that the trailing end of the recording medium when it is fed is at the head. The recording medium is contained in an intermediate tray 22 in this manner. Thereafter, the recording medium is conveyed again from this intermediate tray 22 to the transfer unit 5, and an image is formed on the other surface of the recording medium through the image formation procedure described above.

To prevent scattering and adhesion of powdery substances on the recording medium carrier sheet 5f of the transfer drum 5a and adhesion of oil on the recording medium, cleaning is performed by using a fur brush 14 and a backup brush 15 which opposes the fur brush 14 via the recording medium carrier sheet 5f, and by using an oil removing roller 16 and a backup brush 17 which opposes the oil removing roller 16 via the recording medium carrier sheet 5f. This cleaning is performed before or after the image formation, and when a jam (paper jam) occurs.

In this embodiment, an eccentric cam 25 is operated at a desired timing to activate a cam follower 5i integrated with the transfer drum 5a. This makes it possible to set any given gap between the recording medium carrier sheet 5f and the photosensitive drum 1. As an example, the transfer drum 5a and the photosensitive drum 1 are spaced apart from each other in a standby (waiting) state or when the power is OFF.

The developing devices and the developing agents contained in the developing devices will be described below.

Each color developing device incorporates a conventionally known magnet and carries and transports a developing agent (to be described later) by rotating a developing sleeve on the outer circumference thereof. In a developing nip portion in contact with the photosensitive drum, the developing device lets fly, upon application of a developing bias (not shown) set for each color, only toner onto a color-separated latent image formed on the photosensitive drum, thereby developing the latent image.

The developing agent is stirred constantly by an internal screw. The toner concentration is measured by a developing agent concentration measuring device (not shown), and a necessary amount of toner is replenished by a toner replenishing device (not shown) as needed. Consequently, a developing agent with a fixed concentration is supplied to the developing sleeve at any instant.

The color developing agent contained in each developing device is a two-component developing agent consisting of a magnetic carrier and a color toner component of one of magenta, yellow, cyan, and black which corresponds to that developing device.

In each color developing agent, a toner component T [g] and a carrier C [g] are mixed at s ratio Given by:

$$\frac{T}{T+C} \times 100 = 5(\%)$$

In the fixed developing unit of this embodiment, the arrangement order of the four developing devices 4Y, 4M, 4C, and 4K containing the developing agents (toner components) of different colors is different from those of the conventional examples mentioned earlier. That is, as shown in FIG. 1, the developing devices are arranged in an order of yellow, magenta, cyan, and black from the upstream to the downstream side in the rotating direction of the photosensitive drum 1. The visual sensitivity of the yellow toner is lowest, and that of the black toner is highest. The visual sensitivity of the magenta toner and the cyan toner is intermediate between that of the yellow toner and the black toner. Therefore, the developing devices are essentially arranged in an ascending order of the visual sensitivity from the upstream to the downstream side in the rotating direction of the photosensitive drum.

As a consequence, when the yellow toner of the two-component developing agent contained in the yellow developing device 4Y on the most upstream side flew and was mixed in the magenta, cyan, and black developing devices 4M, 4C, and 4K on the downstream side, no problem was caused on the formed image by this color mixing because yellow has a low visual sensitivity. Likewise, the color mixing in the black developing device 4K caused by the scattering of the magenta toner from the magenta developing device 4M or the scattering of the cyan toner from the cyan developing device 4C brought about no problem on the formed image, since these colors are also low in visual sensitivity.

In addition, since the black developing device 4K is positioned on the most downstream side, toner particles scattering from the black developing device 4K flow to the downstream side in the rotating direction of the photosensitive drum 1. Therefore, no color mixing is caused in other developing devices, so no imperfect images are formed.

There are some conventional apparatuses in which full-color images are formed by three colors of cyan, magenta, and yellow, and a black developing device 4K is arranged on the most downstream side in the direction of rotation of a photosensitive drum in order to perform only monochromatic copying. The effect of the present invention, however, is remarkable especially when the black developing device 4K is arranged on the most downstream side in the full-color image forming apparatus in which full-color images are formed by the four colors by using the black developing device 4K in every image formation.

As described above, the arrangement of this embodiment makes it possible to perform high-quality image formation free from inconveniences such as color mixing.

In this embodiment, the individual color developing devices are operated in an order of cyan, magenta, yellow, and black, which is different from the arrangement order. That is, the cyan developing device 4C performs the development first, but the development is performed from the downstream to the upstream side in the rotating direction of the photosensitive drum 1. After the yellow developing device 4Y on the most upstream side performs a development operation, operation is shifted to the black developing device 4K on the most downstream side. This shift, however, is for merely returning the operation position of the developing device to the start side, so it can be said that the operation order of the developing devices in this embodiment is essentially from the downstream to the upstream side.

Furthermore, in continuous image formation, the developing devices are repeatedly operated in this order so that the operation order of the developing devices is from the downstream to the upstream side in the rotating direction of the photosensitive drum at any instant.

In this embodiment as described above, the development sequence of the developing devices is executed periodically from the downstream to the upstream side in the continuous image formation. This consequently makes it unnecessary to idle the transfer drum, which is a drawback of conventional examples discussed earlier, even if copying is continuously performed on A3-size recording paper.

Figure 2:
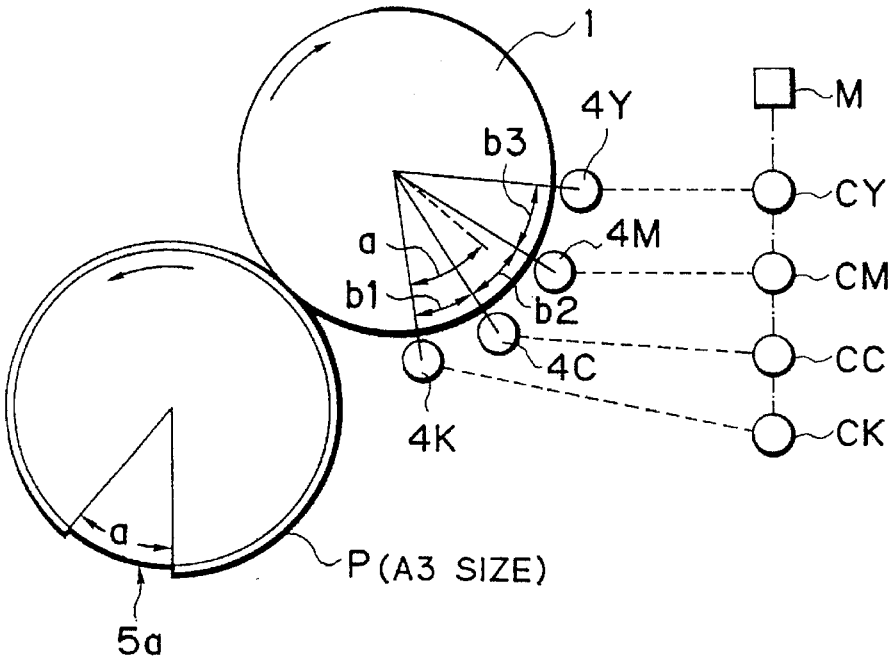
FIG. 2 is a schematic view for explaining the arrangement order and the developing operation of developing devices and the transfer operation in the color image forming apparatus shown in FIG. 1.

This advantage will be described in more detail below with reference to FIG. 2. As discussed earlier, when A3-size recording paper P is fed to the transfer drum 5*a*, a length of a [mm] in which no recording paper P is present exists on the transfer drum 5*a* in the rotating direction. This length a is larger than any of distances b1 [mm] (a distance between the black and cyan developing devices 4K and 4C), b2 [mm] (a distance between the cyan and magenta developing devices 4C and 4M), and b3 [mm] (a distance between the magenta and yellow developing devices 4M and 4Y). The length a is smaller than (b1+b2+b3).

In transferring the individual color toner images to one A3-size recording sheet, the developing operations are performed from the cyan developing device 4C to the upstream side in an order of the magenta developing device 4M to the yellow developing device 4Y. The operation is then shifted from the yellow developing device 4Y on the most upstream side to the black developing device 4K on the most downstream side and ended. In this case, no problem arises since the formation of these toner images can be performed by switching the developing devices while the transfer drum 5*a* rotates distances of (a–b2) [mm], (a–b3) [mm], and (a+b1+b2+b3) [mm].

When the second recording paper is continuously fed in a continuous copying mode, the distance from the trailing end of the first paper to the leading end of the second is only a [mm] as described above. In this embodiment, however, the developing operations are performed from the cyan developing device 4C on the downstream side to the upstream side in an order of the magenta developing device 4M to the yellow developing device 4Y. The developing operation is finally shifted from the yellow developing device 4Y on the most upstream side to the black developing device 4K on the most downstream side. Thereafter, the development operation is repeatedly executed in this order. Therefore, when the trailing end of the black image formed on the photosensitive drum 1, i.e., the trailing end of the last latent image on the first paper passes by the black developing device 4K upon switching of the development operation from the black developing device 4K to the cyan developing device 4C, the leading end of the first cyan latent image on the second paper is in a position separated from the cyan developing device 4C by (a–b1) [mm] toward the upstream side. For this reason, since switching between the developing devices can be executed during this period, the transfer drum 5*a* need not be idled once.

This makes unnecessary the time which is required in conventional systems to idle the transfer drum 5*a* once before a second recording paper is fed, thereby starting the development operation from the cyan latent image. This consequently eliminates drawbacks of a low copying speed and degradation in mechanical performance.

In addition, two or more developing devices do not perform developing operations at the same time. Therefore, as shown in FIG. 2, the development operation can be executed by driving only one developing device by using a single motor M via clutches CY, CM, CC, and CK of the respective colors. Consequently, a high-quality development can be performed since, during development of one latent image performed by one developing device, no other developing device is driven to produce a torque variation.

In the above first embodiment, the color developing devices are arranged in an order of yellow, magenta, cyan, and black from the upstream to the downstream side in the rotating direction of the photosensitive drum, and the development operation is performed in an order of cyan, magenta, yellow, and black, which is different from the above arrangement order. In the second embodiment of the present invention, however, the color developing devices are arranged in an order of yellow, cyan, magenta, and black from the upstream to the downstream side, and the development operation is performed in an order of magenta, cyan, yellow, and black from the downstream to the upstream side. In this second embodiment, an effect identical with that of the above first embodiment was obtained. That is, it was possible to drive the individual developing devices by using a single motor without requiring extra idling of a transfer drum and producing a variation in torque. In addition, the same effect as in the first embodiment was also obtained in color mixing.

The third embodiment of the present invention will be described below with reference to FIG. 3. In this third embodiment, a full-color image is obtained by causing a transfer drum to carry an A4-size recording medium and sequentially transferring toner images of four colors onto the medium. Note that in the third embodiment, as in the second embodiment described above, individual color developing devices are arranged in an order of yellow, cyan, magenta, and black from the upstream to the downstream side in the rotating direction of a photosensitive drum 1, and development is performed in an order of magenta, cyan, yellow, and black from the downstream to the upstream side.

Figure 3:
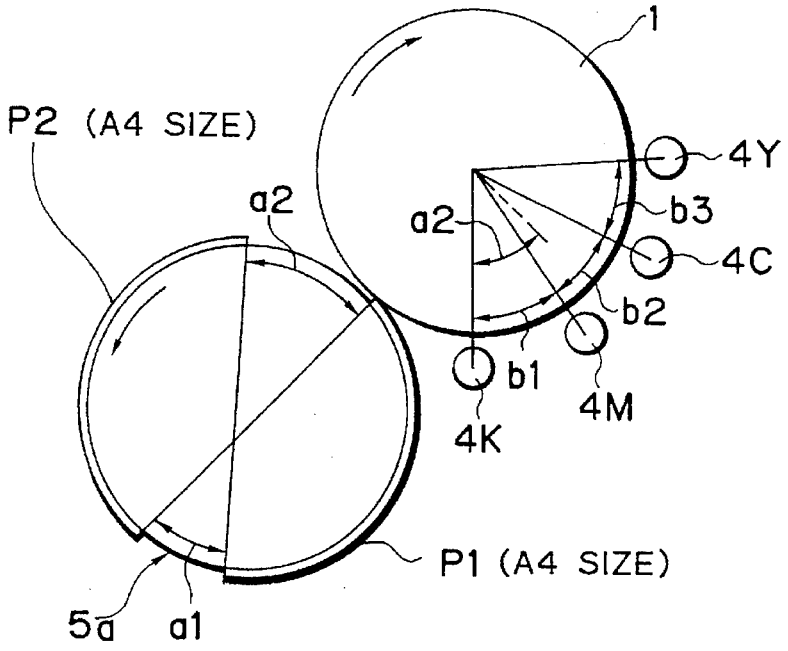
FIG. 3 is a schematic view for explaining the arrangement order and the developing operation of developing devices and the transfer operation in a color image forming apparatus according to a third embodiment of the present invention.

In this embodiment, as shown in FIG. 3, two A4-size recording media (recording paper) P1 and P2 are attracted to and carried on a transfer drum 5*a* with unequal spacings between them. This operation of causing the transfer drum 5*a* to attract and carry two recording sheets of an A4 or smaller size is a conventionally known operation, and so a detailed description thereof will be omitted.

When the two recording sheets P1 and P2 are attracted to and carried by the transfer drum 5*a*, a development operation is performed in an order of magenta, cyan, yellow, and black, as described above. However, each developing device successively develops latent images for the two recording sheets P1 and P2 and sequentially transfers the developed images onto the recording sheets P1 and P2. That is, in this embodiment, a magenta developing device 4M continuously develops two magenta latent images formed on the photosensitive drum 1 and sequentially transfers them to the two recording sheets P1 and P2. Subsequently, a cyan developing device 4C continuously develops two cyan latent images formed on the photosensitive drum 1 and sequentially transfers them to the two recording sheets P1 and P2. Thereafter, a yellow developing device 4Y continuously develops two yellow latent images formed on the photosensitive drum 1 and sequentially transfers them to the two recording sheets P1 and P2. Lastly, a black developing device 4K continuously develops two black latent images formed on the photosensitive drum 1 and sequentially transfers them to the two recording sheets P1 and P2.

Also, in this embodiment, the two A4-size recording sheets P1 and P2 are attracted to and carried on the transfer drum 5*a* with unequal spacings between them so that a length a2 [mm] from the trailing end of the recording paper P2 to the leading end of the recording paper P1, in which no recording paper is present, is longer than any of distances b1 [mm], b2 [mm], and b3 [mm] between the developing devices. For example, the distance a2 from the trailing end of the recording paper P2 to the leading end of the recording paper P1 was set at about 105 [mm], and a distance al from the trailing end of the recording paper P1 to the leading end of the recording paper P2 was set at about 40 [mm]. The distances b1, b2, and b3 between the developing devices were set at 80 [mm], 85 [mm], and 90 [mm], respectively. As a result, the same effect as in the above first embodiment could be obtained.

The fourth embodiment of the present invention will be described below with reference to FIG. 4. In this fourth embodiment, two A4-size recording sheets are attracted to and carried on a transfer drum with equal spacings between them. Note that in the fourth embodiment, as in the second embodiment discussed earlier, individual color developing devices are arranged in an order of yellow, cyan, magenta, and black from the upstream to the downstream side in the direction of rotation of a photosensitive drum 1, and a development operation is performed in an order of magenta, cyan, yellow, and black, from the downstream to the upstream side.

Figure 4:
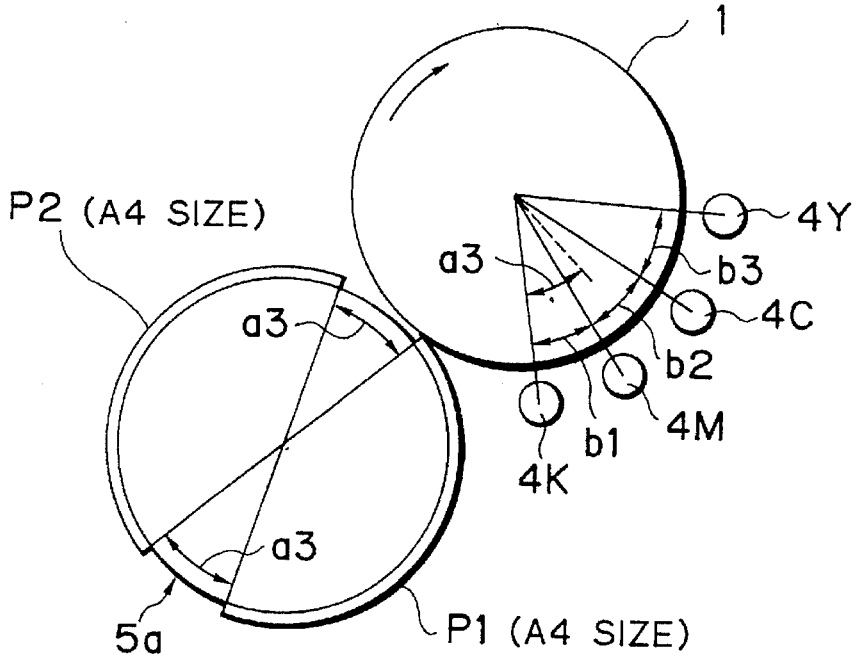
FIG. 4 is a schematic view for explaining the arrangement order and the developing operation of developing devices and the transfer operation in a color image forming apparatus according to a fourth embodiment of the present invention.

In this embodiment, as shown in FIG. 4, two A4-size recording media (recording paper) P1 and P2 are attracted to and carried on a transfer drum 5*a* with equal spacings (a3) between them. As in the above third embodiment, the development operation is performed in an order of magenta, cyan, yellow, and black, and each developing device successively develops latent images for the two recording sheets P1 and P2 and sequentially transfers the developed images onto the recording sheets P1 and P2. That is, a magenta developing device 4M continuously develops two magenta latent images formed on the photosensitive drum 1 and sequentially transfers them to the two recording sheets P1 and P2. Subsequently, a cyan developing device 4C continuously develops two cyan latent images formed on the photosensitive drum 1 and sequentially transfers them to the two recording sheets P1 and P2. Thereafter, a yellow developing device 4Y continuously develops two yellow latent images formed on the photosensitive drum 1 and sequentially transfers them to the two recording sheets P1 and P2. Lastly, a black developing device 4K continuously develops two black latent images formed on the photosensitive drum 1 and sequentially transfers them to the two recording sheets P1 and P2.

In this embodiment, a distance (a length in which no recording paper is present) from the trailing end of the recording paper P1 to the leading end of the recording paper P2 and a distance (a length in which no recording paper is present) from the trailing end of the recording paper P2 to the leading end of the recording paper P1 were equally a3 [mm], and a3= about 72 [mm]. In addition, distances b1 [mm], b2 [mm], and b3 [mm] between the developing devices were set to be shorter than a3, and b1=b2=b3=60 [mm]. As a result, the same effect as in the above first embodiment could be obtained.

Furthermore, the following advantage can also be obtained by the arrangement of this embodiment.

Figure 5:
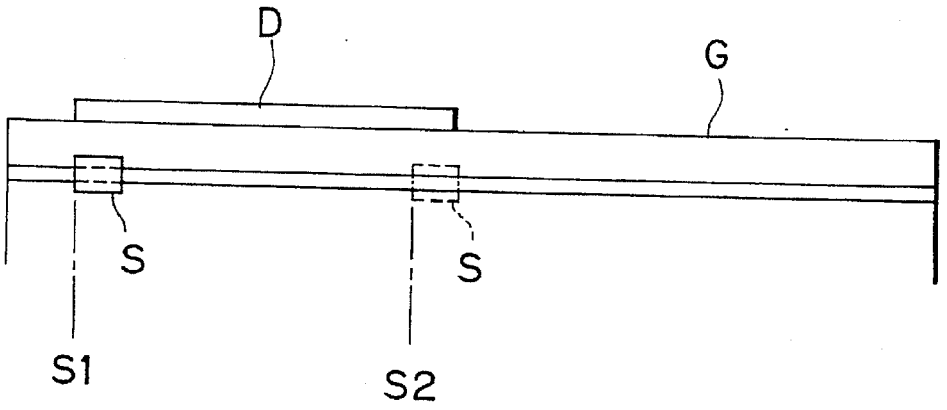
FIG. 5 is a schematic side view showing the reader section of a color image forming apparatus.

That is a copying operation is usually performed by reading an original. FIG. 5 shows a conventional reader in which an A4-size original D is placed on an original glass plate G and read by a scanner S consisting of, e.g., a CCD. A signal representative of the original D read by the scanner S is processed and radiated as the laser exposing beam mentioned earlier onto a photosensitive drum in nearly real time.

After reading the original D, the scanner S must return (back scan) rapidly from a read end position S2 to a read start position S1. If, however, the two recording sheets P1 and P2 are attracted to and carried on the transfer drum with unequal spacings between them as in the above third embodiment illustrated in FIG. 3, this rapid return must be performed within the shorter distance al from the trailing end of the first recording sheet P1 to the leading end of the second recording sheet P2. For this purpose, it is required to increase the capacity of a scan motor (not shown) or employ a conventionally known system in which images are stored in a memory so that scan need not be executed each time, leading to an increase in the manufacturing cost.

With the arrangement of this embodiment, however, a speed at which the scanner performs the back scan each time can be set at a speed at which the scanner can return within the distance a3 which is longer than al. This makes it possible to simplify the arrangement of the image forming apparatus.

This embodiment also can achieve the same effect of eliminating the scattering of toner particles and the loss of a copying operation as in the first embodiment.

Figure 9:
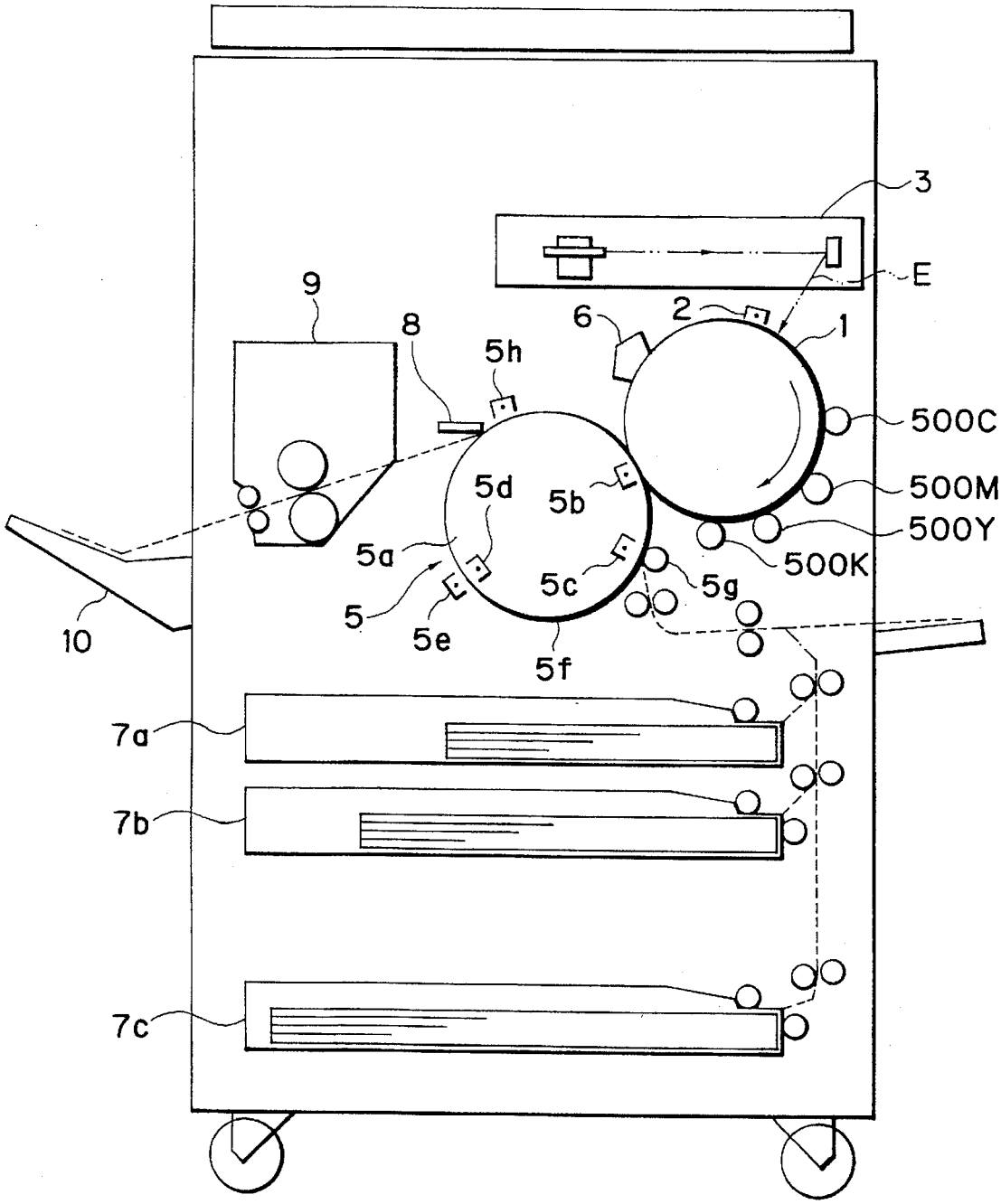
FIG. 9 PRIOR ART
FIG. 9 is a schematic view showing the overall arrangement of another example of a conventional electrophotographic color image forming apparatus.
Figure 10:
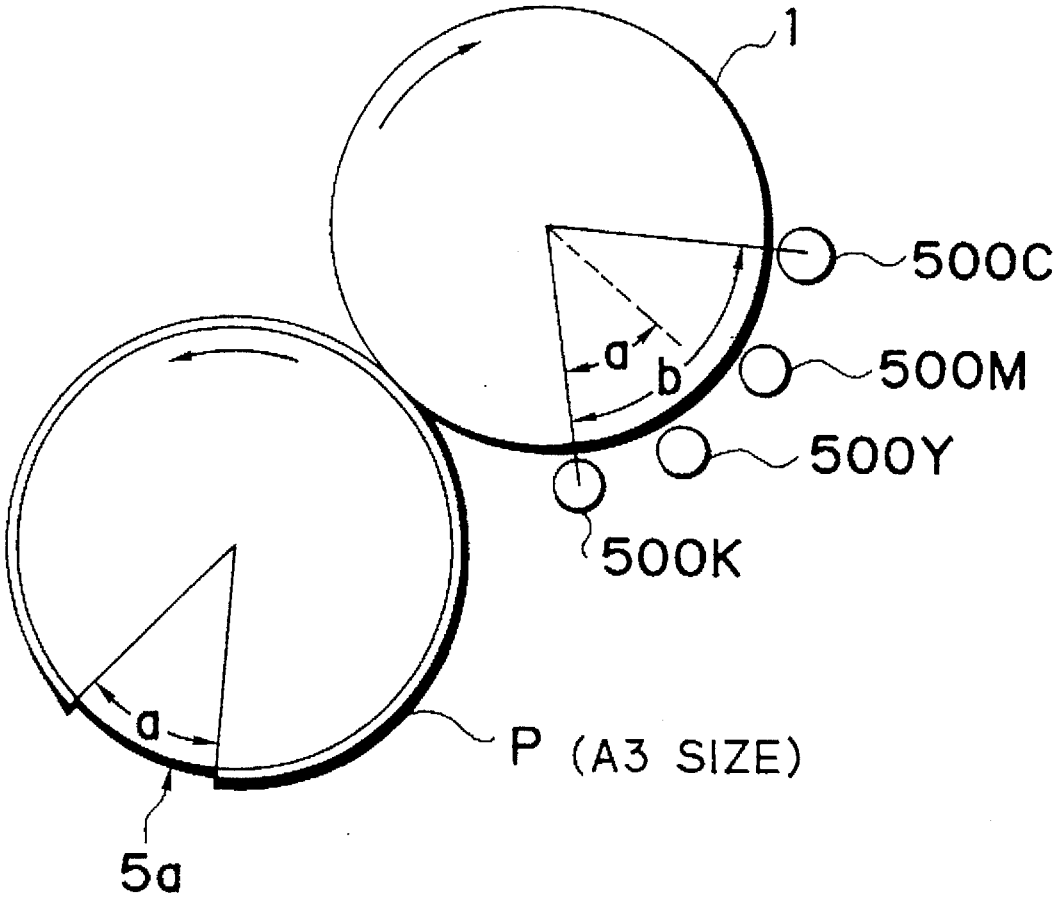
FIG. 10 PRIOR ART
FIG. 10 is a schematic view for explaining the arrangement order and the developing operation of developing devices and the transfer operation in the conventional color image forming apparatus shown in FIG. 9.

Incidentally, as discussed earlier in the conventional image forming apparatus shown in FIG. 9, each color developing device generally has its own development biasing means. In addition, even in this conventional example, another development biasing means is required when the developing operation shifts from the black developing device 4K to the cyan developing device 4C; i.e., at least two development biasing means are necessary. This is so because the setting of the developing bias potential changes between the black and cyan developing devices 4K and 4C.

Figure 6:
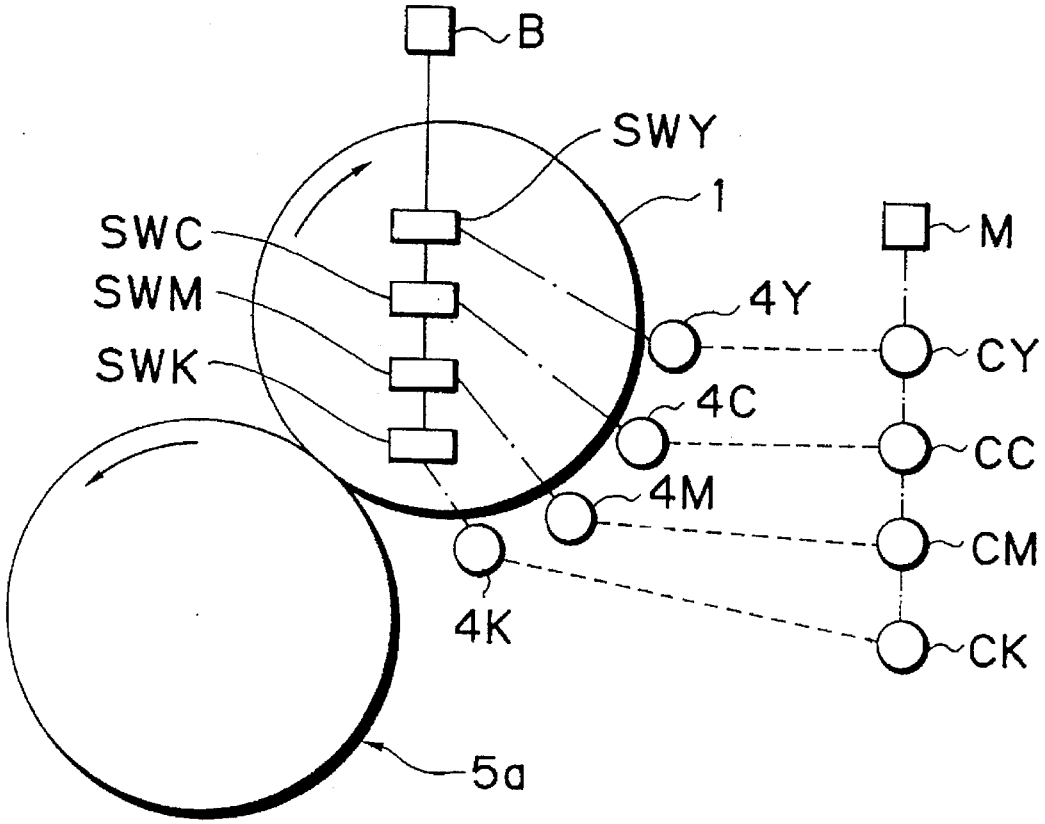
FIG. 6 is a schematic view for explaining the driving of developing devices and the application of developing biases in a color image forming apparatus according to the present invention.

According to the arrangements of the first to fourth embodiments of the present invention, however, the apparatus has only one development biasing means B as shown in FIG. 6, and this development biasing means B can be used selectively between the color developing devices. That is, in each embodiment, only one developing device operates during development. Therefore, while one developing device is in operation, the driving force of a development motor M need not be supplied to the next developing device. Similarly, the developing bias need not be supplied to two developing devices. For this reason, as shown in FIG. 6, the developing bias can be selectively supplied from a single development biasing means B to one of the developing devices through switches SWY, SWC, SWM, and SWK. In the above first embodiment, the arrangement order of the developing devices is different from that shown in FIG. 6. However, this first embodiment is identical with other embodiments in that the developing bias is selectively applied and the developing devices are also selectively driven. Therefore, the arrangement order of the developing devices in the second to fourth embodiments is illustrated as a representative example in FIG. 6.

Consequently, although four development biasing means are required in conventional apparatuses, the present invention requires only one development biasing means, and this makes it possible to realize an image forming apparatus whose manufacturing cost and installation space are reduced.

The fifth embodiment of the present invention will be described below.

Figure 7:
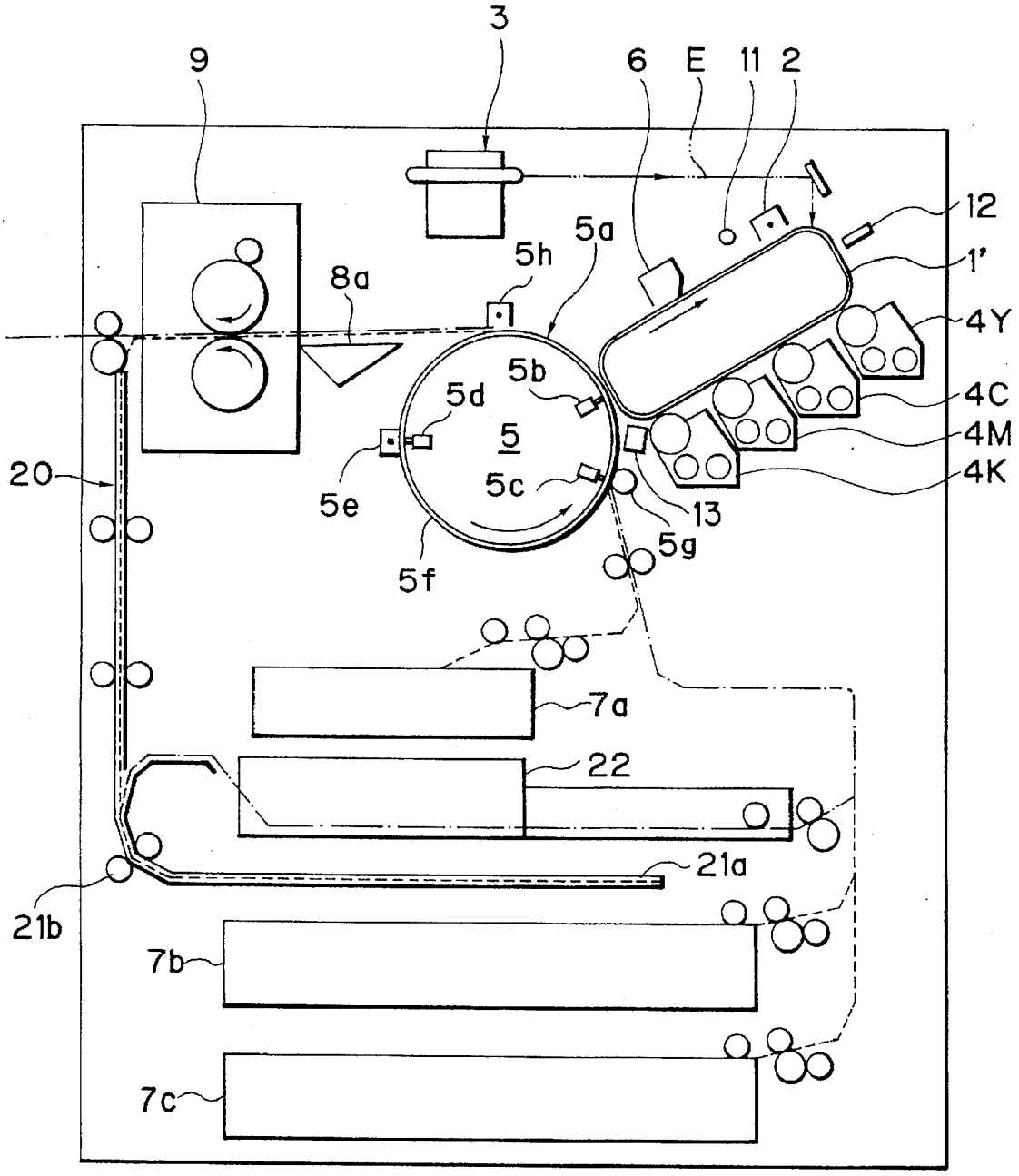
FIG. 7 is a schematic view showing the overall arrangement of a fifth embodiment in which the present invention is applied to an electrophotographic color image forming apparatus.
Figure 8:
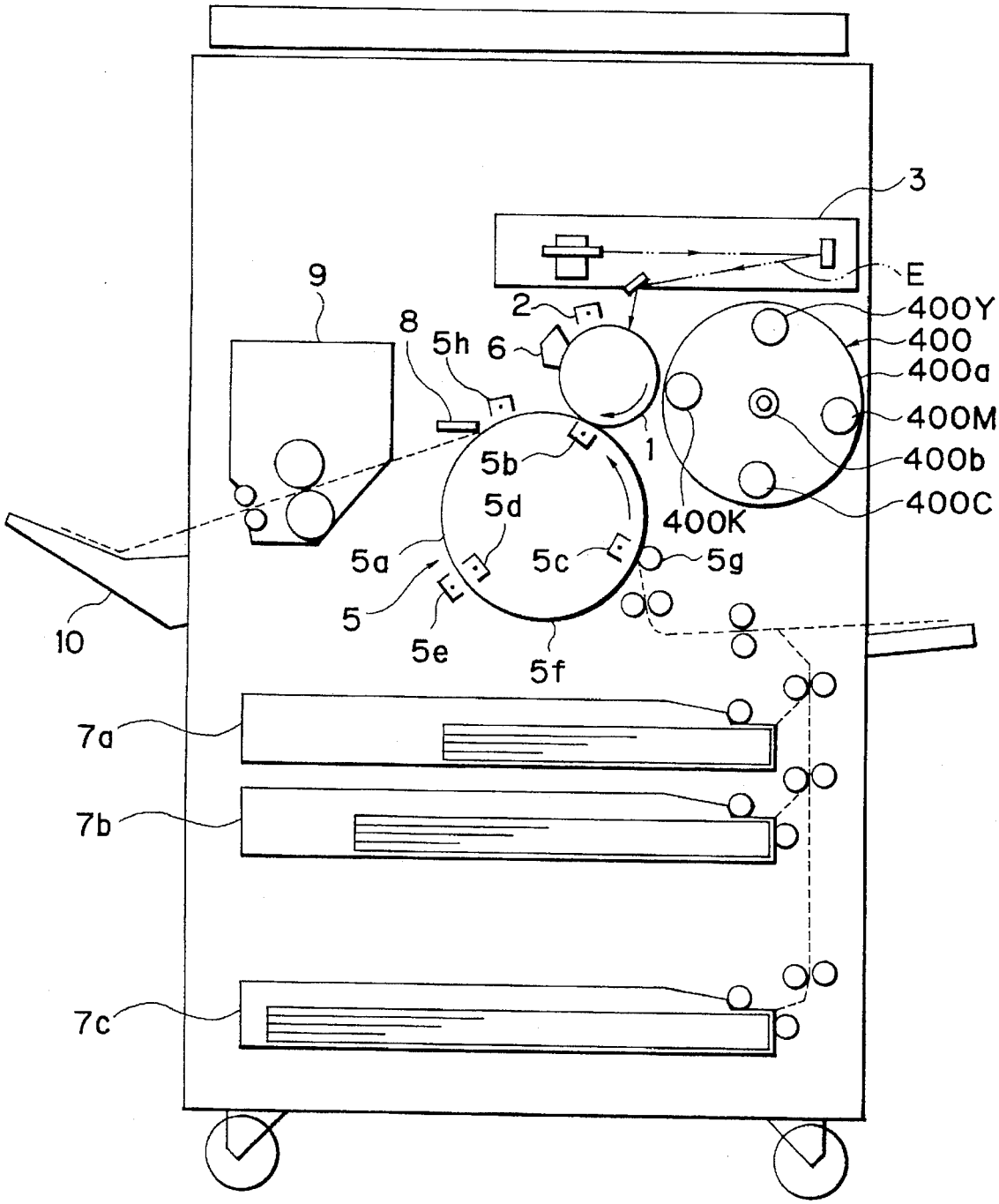
FIG. 8 PRIOR ART
FIG. 8 is a schematic view showing the overall arrangement of an example of a conventional electrophotographic color image forming apparatus.

FIG. 7 is a schematic view showing the overall arrangement of a fifth embodiment in which the present invention is applied to an electrophotographic color image forming apparatus. In place of the photosensitive drum used as an image carrier in the color image forming apparatus of the first embodiment shown in FIG. 1, this color image forming apparatus uses a photosensitive belt 1', as an image carrier, which is looped to be movable in a direction indicated by an arrow shown in FIG. 7. Around this photosensitive belt 1', there are disposed a pre-exposure lamp 11 for initializing the surface of the photosensitive belt 1', a charger 2 (in this embodiment, a corona charger) for evenly charging the surface of the photosensitive belt 1', an image exposing means 3 for forming an electrostatic latent image corresponding to image information on the photosensitive belt 1', a potential sensor 12 for sensing the surface potential of the photosensitive belt 1', a fixed developing unit including four developing devices 4Y, 4C, 4M, and 4K containing developing agents (toner components) of different colors for developing the electrostatic latent image formed on the photosensitive belt 1' into a visible image, a photodetecting means 13 for detecting the toner amount on the photosensitive belt 1', a transfer unit 5 including a transfer drum 5*a* as a recording medium carrier, and a cleaner 6 for removing any developing agents and the like remaining on the photosensitive belt 1'.

In the fixed developing unit of this embodiment, as shown in FIG. 7, the four developing devices 4Y, 4C, 4M, and 4K containing the developing agents (toner components) of different colors are arranged in an order of yellow, cyan, magenta, and black from the upstream to the downstream side in the direction of movement of the photosensitive belt 1'. The order of operations of these color developing devices is different from the arrangement order; i.e., the operations are performed in an order of magenta, cyan, yellow, and black. That is, although the development operation is started from the magenta developing device 4M, it is performed from the downstream to the upstream side in the moving direction of the photosensitive belt 1'. The development operation is shifted from the yellow developing device 4Y to the black developing device 4K, i.e., from the upstream to the downstream side, but this is done to merely return the operation position of the developing device to the start side. Therefore, it can be said that the operation is essentially performed from the downstream to the upstream side.

In addition, in continuous image formation, the developing devices are repeatedly operated in this order so that the operation order of the developing devices is from the downstream to the upstream side in the moving direction of the photosensitive belt at any instant. Any other arrangement is nearly identical with that of the electrophotographic color image forming apparatus of the first embodiment shown in FIG. 1. Therefore, the same reference numerals as in FIG. 1 denote the same members, parts, and elements in FIG. 7, and a detailed description thereof will be omitted unless it is necessary.

The photosensitive belt has the advantage that developing devices of the same structure can be used for individual colors. Since, however, the developing devices are disposed linearly along the moving direction of the belt as shown in FIG. 7, the degree of scattering of toner particles is greater than that in the above embodiment.

In this embodiment with the above arrangement, however, even when yellow toner particles of a two-component developing agent contained in the yellow developing device 4Y on the most upstream side scattered and were mixed in the magenta, cyan, and black developing devices 4M, 4C, and 4K on the downstream side, no problem arose on the formed image because yellow has a low visual sensitivity. Likewise, no problem was caused in the black developing device 4K by color mixing resulting from the scattering of cyan toner from the cyan developing device 4C or the scattering of magenta toner, since these colors are also low in visual sensitivity.

As a result, like the arrangements of the above embodiments, the arrangement of this embodiment also makes it possible to perform high-quality image formation free from inconveniences such as color mixing.

In addition, in continuous image formation, development by the developing devices was done periodically from the downstream to the upstream side. Consequently, good images could be formed without idling the transfer drum, which is a drawback of the conventional apparatuses, in both continuous copying for one A3-size recording sheet carried on the transfer drum 5*a* and continuous copying for two A4-size recording sheets carried on the transfer drum 5*a* with either unequal or equal spacings between them as shown in FIG. 3 or 4.

Furthermore, it was possible to obtain the same effect when the positions of the magenta and cyan developing devices 4M and 4C were switched in FIG. 7, i.e., when the developing devices were arranged in an order of yellow, magenta, cyan, and black from the upstream to the downstream side in the moving direction of the photosensitive belt 1', or when the color developing devices were operated in an order of cyan, magenta, yellow, and black.

In each of the above embodiments, the present invention is applied to an electrophotographic color image forming apparatus. However, the present invention is equally applicable to other various image forming apparatuses of an electrophotographic type, such as printers and copying machines, and to various image forming apparatuses of other types than the electrophotographic type, such as printers and copying machines. In addition, it is naturally possible to modify and change, if necessary, the arrangements, the shapes, and the operations of various members, parts, and elements constituting the image forming apparatus, such as the image carrier, the developing unit, and the recording medium carrier.

As an example, in the apparatus of each of the above embodiments, images are formed by winding a recording medium around the transfer drum. However, the same effect can be obtained by applying the present invention to an image forming apparatus in which images are transferred directly onto a transfer drum conventionally known as an intermediate transfer member, and then simultaneously transferred from the transfer drum onto a recording medium.

Furthermore, the photosensitive drum and the transfer drum have the same diameter of 180 mm in each of the above embodiments, but the diameter is not limited to this value. That is, the present invention is similarly applicable to an image forming apparatus using photosensitive and transfer drums having another diameter or diameters different from each other. Also, image exposure can be performed using a signal from a memory of, e.g., a computer as well as the signal from the reader.

Although the preferred embodiments of the present invention have been described above, the present invention is not limited to the above embodiments but can be modified without departing from the spirit and scope of the invention.

What is claimed is:

1. An image forming apparatus comprising:

a movable image carrier; and a plurality of developing devices for developing a latent image formed on said movable image carrier, wherein a developing image on said movable image carrier is formed on a single recording medium, wherein said plurality of developing devices are arranged in a direction of movement of said movable image carrier, and are operated in sequence from the downstream to the upstream side in the direction of movement of said movable image carrier, and wherein when an image is formed on the single recording medium, the development of the developing device on the downstream side is started after the development of a developing device on the upstream side in the direction of movement of said movable image carrier is ended.

2. An apparatus according to claim 1, wherein a color of the developing device on the most downstream side is black.

3. An apparatus according to claim 1, wherein said plurality of developing devices are operated repeatedly.

4. An apparatus according to claim 1, further comprising a movable recording medium carrier, opposing said image carrier, for carrying a recording medium, wherein when said recording medium carrier carries a recording medium, a length of a portion in a direction of movement of said recording medium carrier in which no recording medium is present is larger than distances between adjacent developing devices of said plurality of developing devices.

5. An apparatus according to claim 4, wherein the length of the portion in the direction of movement of said recording medium carrier in which no recording medium is present is equal to a distance from a trailing end to a leading end of the recording medium.

6. An apparatus according to claim 4, wherein when said recording medium carrier carries a plurality of recording mediums, lengths of a plurality of portions in the direction of movement of said recording medium carrier in which no recording mediums are present are equal.

7. An image forming apparatus comprising:

a movable image carrier; and a plurality of developing devices for developing a latent image formed on said movable image carrier;

wherein a developing image on said movable image carrier is formed on a single recording medium, wherein said plurality of developing devices comprise cyan, magenta, yellow, and black developing devices arranged in an order of cyan, magenta, yellow, and black from an upstream side in a moving direction of said movable image carrier, and when the image is formed on the single recording medium, said developing devices are operated in an order of cyan, magenta, yellow and black.

8. An image forming apparatus comprising:

a movable image carrier; and a plurality of developing devices for developing a latent image formed on said movable image carrier;

wherein a developing image on said movable image carrier is formed on a single recording medium, wherein said plurality of developing devices comprises yellow, cyan, magenta, and black developing devices arranged in an order of yellow, cyan, magenta and black from an upstream side in a moving direction of said movable image carrier, and when the image is formed on the single recording medium, said developing devices are operated in an order of magenta, cyan, yellow and black.

9. An image forming apparatus comprising:

a movable image carrier; and a plurality of developing devices for developing a latent image formed on said movable image carrier;

wherein a developing image on said movable image carrier is formed on a single recording medium, wherein said plurality of developing devices are not less than three and arranged in a direction of movement of said movable image carrier, wherein said plurality of developing devices are to be operated in sequence, and wherein when the image is formed on the single recording medium, the development of a developing device on the most downstream side in the direction of movement of said image carrier is started after the development of a developing device on the most upstream side is ended.

10. An apparatus according to claim 9, further comprising a movable recording medium carrier opposing said image carrier, for carrying a recording medium, so that when said recording medium carrier carries a recording medium, a length of a portion in a direction of movement of said recording medium carrier in which no recording medium is present is smaller than a distance between said developing device on the most upstream side and said developing device on the most downstream side of said plurality of developing devices.

11. An apparatus according to claim 9, wherein a color of the developing device on the most downstream side is black.

* * * * *

UNITED STATES PATENT AND TRADEMARK OFFICE

CERTIFICATE OF CORRECTION

PATENT NO. : 5,652,650

DATED : July 29, 1997

INVENTOR(S) : MENJO ET AL.

It is certified that error appears in the above-identified patent and that said Letters Patent is hereby corrected as shown below: On the title page, At [57] Abstract Line 7, "of the" should read --of--.

Column 1

Line 38, "filter.," should read --filter,--.

Column 4

Line 22, "Of" should read --of--; and
Line 47, "ba" should read --a--.

Column 9

Line 18, "s ratio Given" should read --a ratio given--.

Column 11

Line 23, "development" should read --development operation--.

Signed and Sealed this

Seventeenth Day of March, 1998

*Attest:*

*Attesting Officer*

BRUCE LEHMAN

*Commissioner of Patents and Trademarks*